US005765299A

United States Patent [19]

Hayashi et al.

[11] Patent Number: 5,765,299

[45] Date of Patent: Jun. 16, 1998

[54] THREE-PIECE TYPE SKI BOOT

[75] Inventors: Sueyoshi Hayashi; Gohichi Watanabe, both of Osaka, Japan

[73] Assignee: Ryusyo Industrial Co., Ltd., Osaka, Japan

[21] Appl. No.: 781,797

[22] Filed: Jan. 10, 1997

[30] Foreign Application Priority Data

Jan. 11, 1996 [JP] Japan ..... 8-002937

[51] Int. Cl.[6] ..... A43B 5/04

[52] U.S. Cl. ..... 36/117.1; 36/118.2; 36/118.9

[58] Field of Search ..... 36/117.1, 118.2, 36/118.3, 118.4, 118.5, 118.6, 118.7, 118.8, 118.9, 119.1

[56] References Cited

U.S. PATENT DOCUMENTS

| | | | |
|---|---|---|---|
| 5,005,303 | 4/1991 | Bonaventure et al. | 36/118.7 |
| 5,279,053 | 1/1994 | Pallatin et al. | 36/117.1 |
| 5,295,316 | 3/1994 | Bergamin | 36/118.9 |
| 5,329,707 | 7/1994 | Chaigne et al. | 36/118.2 |
| 5,519,951 | 5/1996 | Paris | 36/118.2 |
| 5,548,909 | 8/1996 | Foffano et al. | 36/117.1 |
| 5,564,204 | 10/1996 | Cagliari et al. | 36/118.7 |

FOREIGN PATENT DOCUMENTS

| | | | |
|---|---|---|---|
| 4232058 | 3/1994 | Germany | 36/118.9 |

*Primary Examiner*—M. D. Patterson

*Attorney, Agent, or Firm*—Merchant, Gould, Smith, Edell, Welter & Schmidt

[57] ABSTRACT

A ski boot that satisfies both the ease of operation and a sense of fitness, having a shell including a lower shell for covering mainly a part lower than the ankle, an inner cuff fixed to the lower shell for covering mainly an upper part above the ankle, and an outer cuff fixed to the lower shell and the inner cuff to be clamped by buckles in a manner to wrap the inner cuff from outside. The lower shell is restricted to rise at both side portions thereof at both sides of the leg approximately to a height of the ankle. The inner cuff includes at least side walls for covering the upper part above the ankle at both sides of the leg and, front walls for supporting the shin. To the outer cuff are fixed upper buckles for clamping a calf portion and lower buckles for clamping an ankle portion.

4 Claims, 7 Drawing Sheets

THREE-PIECE TYPE SKI BOOT

BACKGROUND OF THE INVENTION

1. Field of the Invention

The present invention relates to a ski boot having a three-piece shell with superior features fabricated for the purpose of racing.

2. Description of the Prior Art

Two-piece type ski boots as shown in FIGS. 1 and 2 have been used so far. The ski boot of this kind has an inner boot 4 installed within a shell comprising a lower shell 1 and an upper shell 2. Although one-piece type ski boots have been used in old days, two-piece models are now the mainstream, two primaries of which are illustrated in FIGS. 1 and 2.

Regarding the ski boot in FIG. 1, both side portions la of the lower shell 1 rise high, and therefore the whole lower shell 1 itself is constituted like a one-piece ski boot. The nearly one-piece ski boot is superior in its rigidity of both side portions, high response to the skier's forward tilting motion and ease of controlling the skis, whereas the boot fitting the leg poorly inconveniences the insertion or release of the leg.

On the other hand, both side portions 1b of the lower shell 1 of the ski boot shown in FIG. 2 rise merely to the vicinity of the ankle. The ski boot at the calf portion is clamped by the upper shell 2. Since this two-piece type ski boot is tightened at the ankle portion and the calf portion respectively by the lower shell and the upper shell separately from each other, the constitution insures a good fit and smooth insertion/release of the leg. However, due to the reduced extension of the side portions, the ski boot of FIG. 2 lacks rigidity and sufficient response to the forward titling motion. In other words, the operability or control of skis is low.

What is considered to be most essential for racing ski boots today is high rigidity at a part corresponding to both side portions of the leg and high convenience of operation, i.e., high operability to the ski. This is the reason why many of the current first-class skiers choose rigid boots as in FIG. 1 even at the sacrifice of a sense of comfortable fitness. Skiers could gain higher marks if such a ski boot would be provided that ensures a better feeling of fitness while keeping high operability. As mentioned earlier, however, the conventional two-piece type ski boot cannot satisfy both of the operability and good fit.

SUMMARY OF THE INVENTION

The object of the present invention is therefore to provide a ski boot designed to fulfill both the ease of operation and a sense of fitness, with eliminating the above-described demerits of the prior art.

In order to accomplish the above object of the present invention, a three-piece type ski boot is provided, both side portions of a lower shell of which are limited to rise approximately to a height of the ankle, thereby to facilitate the insertion/release of the leg. At the same time, an inner cuff of relatively high rigidity is employed, extending to cover the side portions so as to enhance the rigidity there. The inner cuff is not clamped directly, but via an outer cuff of relatively low rigidity covering and securing the inner cuff from outside with the use of buckles. Accordingly, the rigidity at the side portions becomes high and the sense of fitness from the ankle portion to the calf portion is improved.

A shell of the ski boot of the present invention is constituted of three members, i.e., a lower shell, an inner cuff and an outer cuff. The inner and outer cuffs correspond to the conventional upper shell. The lower shell mainly covers a part lower than the ankle and the inner cuff is fixed to the lower shell and substantially covers an upper part above the ankle. The outer cuff is clamped by buckles in a manner to wrap the inner cuff from outside, which is secured to both the lower shell and the inner cuff. That is, these three members, namely, lower shell, inner and outer cuffs are integrally fixed at one point by fixing means. Although the ski boot is constituted of three separate members, the ski boot shows a sufficiently high degree of integration. The fixing means is preferably a pin member or the like and a count of the fixing means is preferably two or so.

Both side portions of the lower shell are limited to rise approximately to a height of the ankle, making it easy to insert/release the leg into/from the ski boot.

The inner cuff includes at least side walls for covering the upper part above the ankle at both sides of the leg and front walls for supporting the shin. The side walls are provided so as to compensate for the decreased rigidity at the side portions resulting from the small rise of the lower shell at the side portions. The front walls are formed to enhance the response to the forward tilting motion and improve the operability. It is preferred from this point of view that the inner cuff is made of a relatively highly rigid material.

The outer cuff has at least two upper and lower pairs of buckles. The upper pair of buckles clamp the calf portion, while the lower pair of buckles clamp the ankle portion of the ski boot. In other words, the outer cuff is fundamentally intended for the clamping, from the viewpoint of which the outer cuff is preferably formed of a lower rigid material than the inner cuff.

According to the present invention, although the inner cuff of the ski boot is formed of a relatively highly rigid material, the inner cuff itself is in a free state (without being clamped, not like the outer cuff) and deformable to some extent correspondingly to the relative clamping strength at the ankle portion and the calf portion by the outer cuff. More specifically, the inner cuff is deformable relatively changing an inner diameter thereof at the ankle portion and the calf portion. The ski boot of the present invention hence achieves both the high rigidity and the sense of fitness through the way of clamping that the outer cuff of low rigidity is set and clamped by buckles outside the inner cuff of high rigidity.

In the meantime, either one of a hook and a main body constituting each pair of buckles is fixed to a front wall of the outer cuff, with the other being fixed to a side wall of the outer cuff. Preferably, a notch is formed to extend from a side edge of the front wall (or side wall) of the outer cuff between the hook (or main body) of the upper buckle clamping the calf portion and the hook (or main body) of the lower buckle clamping the ankle portion. The presence of the notch enhances independence of the upper buckle related to the clamping of the calf portion from the lower buckle related to the clamping of the ankle portion (that is, the calf portion and ankle portion are clamped independently of each other). The ski boot fits well flexibly to the shape from the ankle to the calf of every skier.

BRIEF DESCRIPTION OF THE DRAWINGS

These and other objects and features of the present invention will become clear from the following description taken in conjunction with the preferred embodiment thereof with reference to the accompanying drawings throughout which like parts are designated by like reference numerals, and in which.

DETAILED DESCRIPTION OF THE PREFERRED EMBODIMENT

An embodiment of a ski boot according to the present invention will be fully described hereinbelow with reference to FIGS. 3–7.

Figure 3:
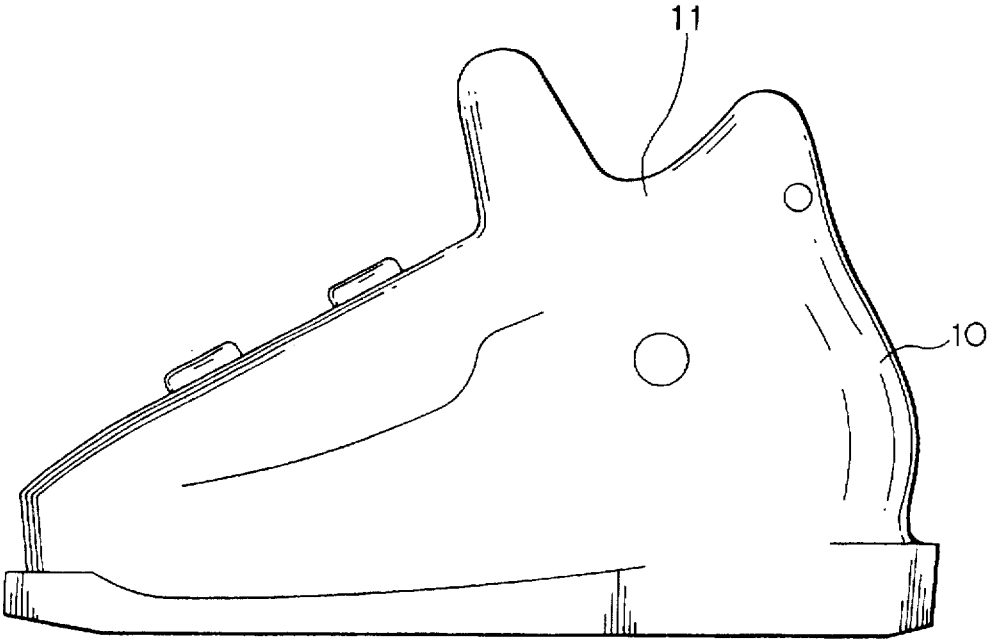
FIG. 3 is a side view of a lower shell of a ski boot according to the present invention.

The ski boot in the present invention has a shell constituted of three pieces, i.e., a lower shell, an inner cuff and an outer cuff. An inner boot is arranged inside the shell. FIG. 3 illustrates the lower shell 10 only, while FIG. 4 indicates a state with the inner cuff 20 attached to the lower shell 10 and FIG. 5 indicates a state with the outer cuff 30 attached further to FIG. 4. The inner boot 40 is shown only in FIG. 5 and omitted in FIGS. 3 and 4. FIG. 6 is a development of a state when the inner cuff 20 and the outer cuff 30 are combined to overlap with each other. The illustrated ski boot is for the right leg, which is in optically inverse relation to one for the left leg.

Figure 1:
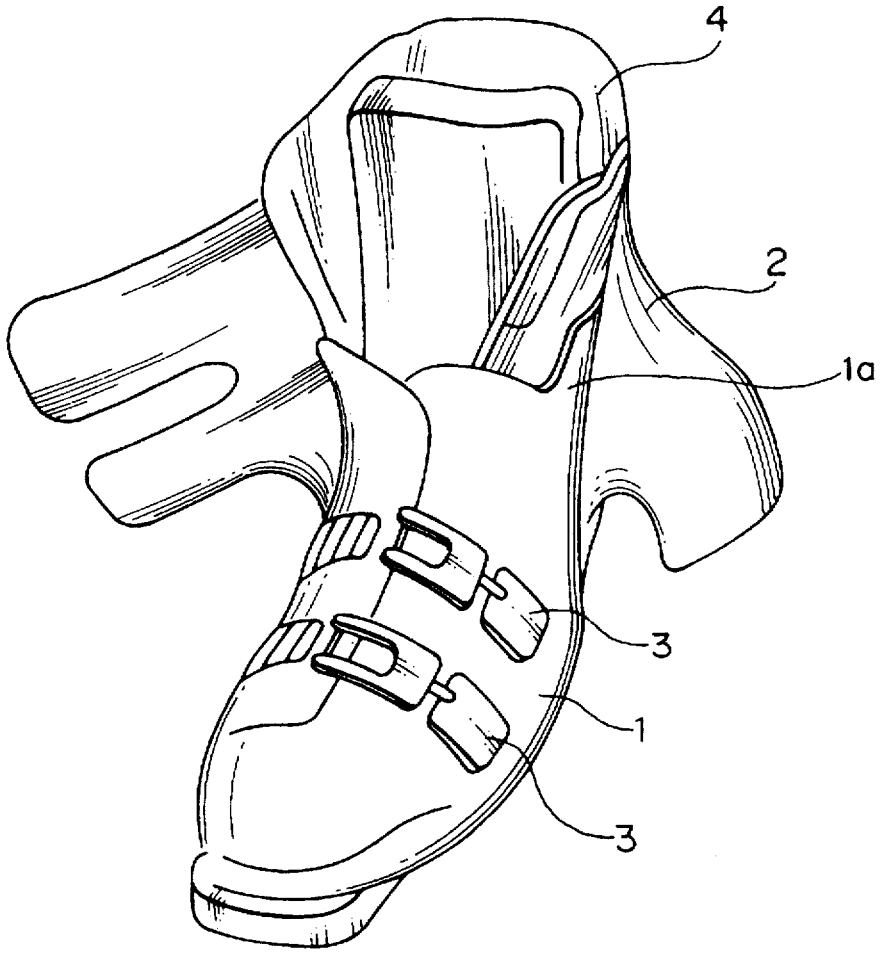
Fig. 1 PRIOR ART
FIG. 1 is a perspective view of a conventional two-piece type ski boot, with a lower shell rising relatively high.
Figure 2:
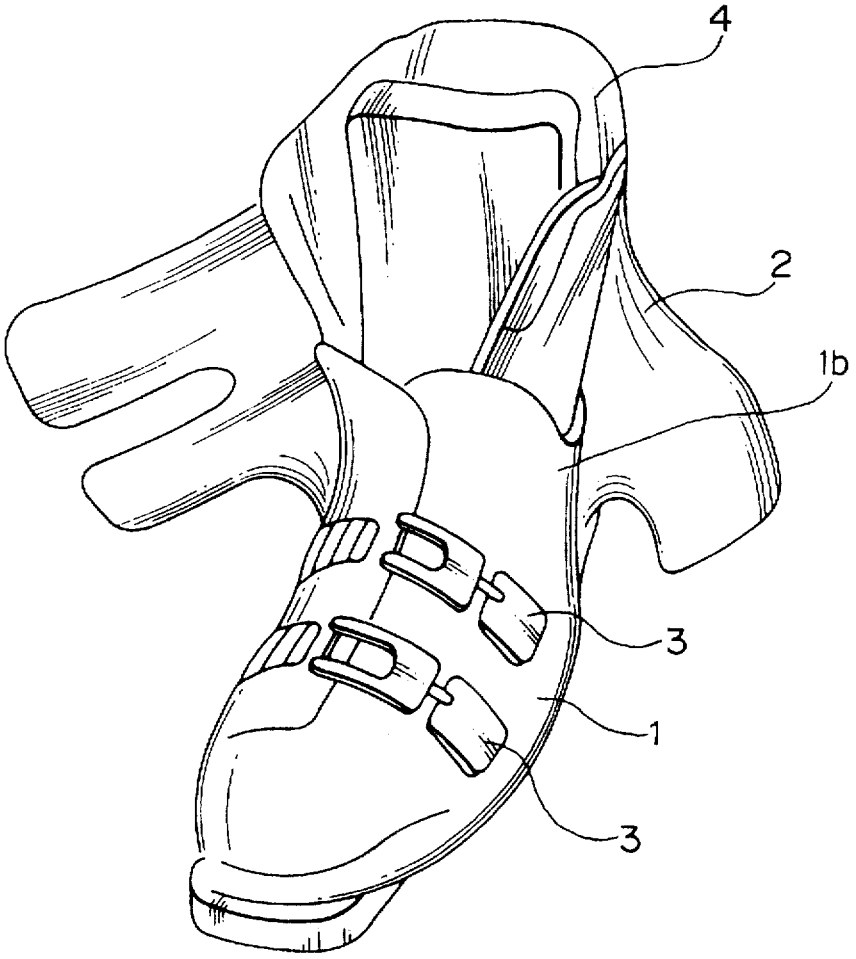
Fig. 2 PRIOR ART
FIG. 2 is a perspective view of a conventional two-piece type ski boot, with a lower shell rising relatively low.

The lower shell 10 of FIG. 3 covers mainly a part lower than the ankle. As is clear from the drawing, a side portion 11 of the lower shell 10 at the inner side of the leg rises slightly and is similar to that of the ski boot of FIG. 2. Likewise, a side portion of the lower shell at the outer side of the leg rises slightly. The ski boot of the present invention consequently facilitates the insertion and release of the leg owing to the restricted rise at both side portions of the lower shell.

Figure 4:
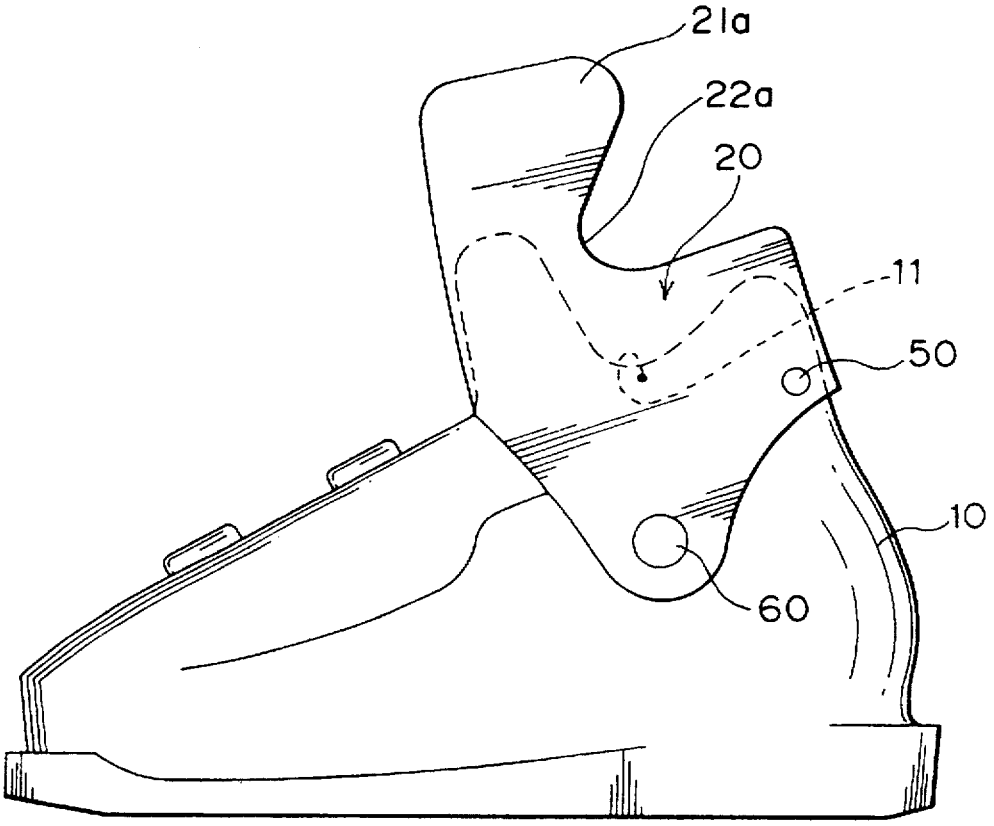
FIG. 4 is a side view of the lower shell of FIG. 3 with an inner cuff attached thereto.

The inner cuff 20 is attached to the lower shell 10 as shown in FIG. 4. The inner cuff 20 is coupled outside the side portions of the lower shell 10, more specifically, at side hinges 60 of cant adjusters or the like, and moreover fixed to the lower shell 10 by fixing means 50, e.g., pins at the side of a rear face of the ski boot. The inner cuff 20 mainly covers an upper part above the ankle. As will be discussed later, the pins 50 fix the outer cuff 30 as well as the inner cuff 20 to the lower shell 10.

Although the rigidity is decreased at both side portions of the lower shell 10 because of the small rise there, the inner cuff 20 fitted to the lower shell increases the rigidity of the ski boot at the side portions. Concretely, the inner cuff 20 has side walls 21*a*, 21*b* for covering the side portions of the leg. Furthermore, the inner cuff 20 has front walls 23*a*, 23*b* continuously formed with the side walls 21*a*, 21*b* (referring to FIG. 6). The front walls 23*a*, 23*b* overlap with each other thereby to support a front part (shin) of the leg, thus securing good response to the forward tilting. A supporting strength (namely, degree of response to the forward tilting) can be adjusted if necessary by eliminating either of the front walls or changing an overlapping area.

As is understood from FIG. 6, the side walls 21*a*, 21*b* of the inner cuff are recessed like inlets at 22*a*, 22*b*, to be gradually narrowed in width downwardly. The rigidity of the side portions can be increased or decreased by the size of the recessed portions 22*a*, 22*b*. If the recesses are made small, the rigidity is enhanced, while the flexibility of the inner cuff is decreased eventually to deteriorate the sense of fitness. On the contrary, if the recesses are formed large, the inner cuff is turned more flexible with improved sense of fitness although the rigidity is lowered. In other words, the rigidity and the sense of fitness can be balanced by changing the size of the recesses.

Figure 5:
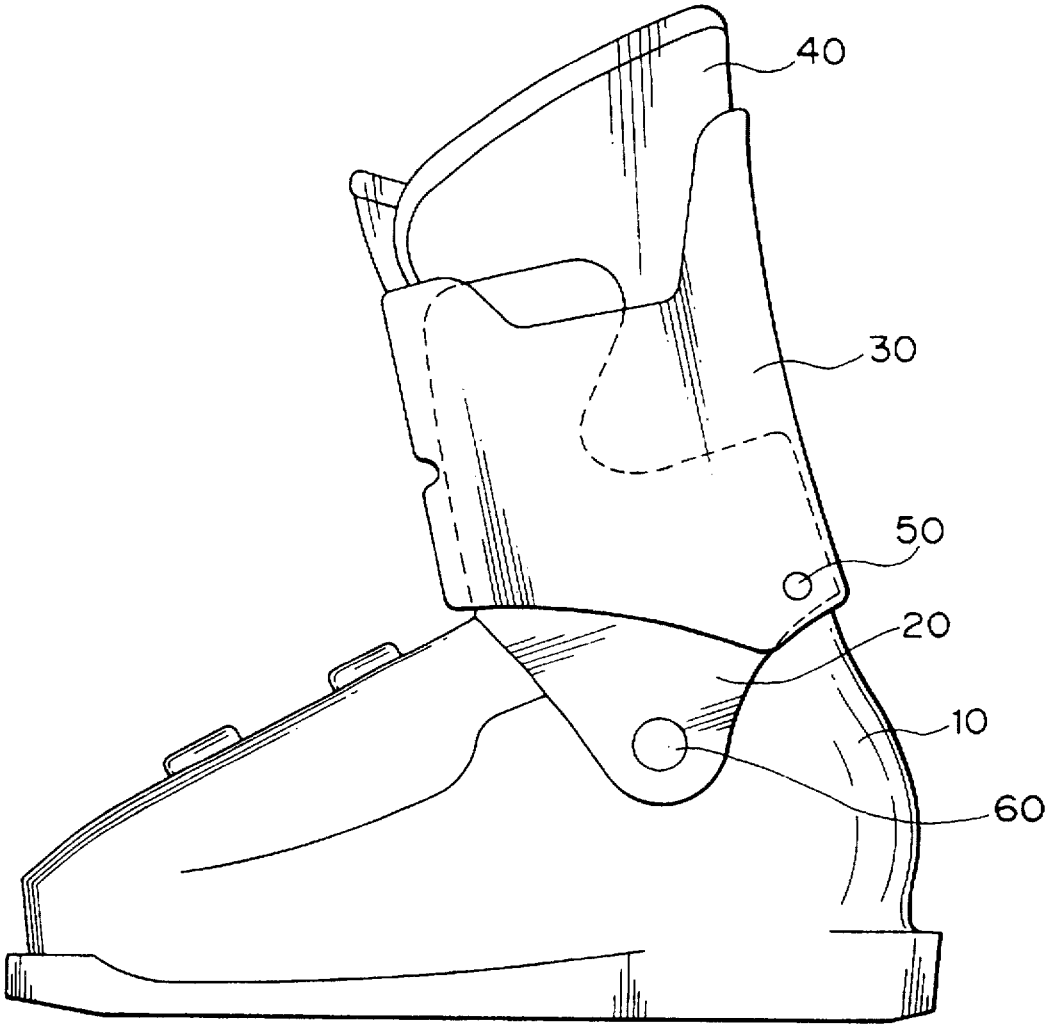
FIG. 5 is a side view of the lower shell of FIG. 4 with an outer cuff attached thereto.
Figure 6:
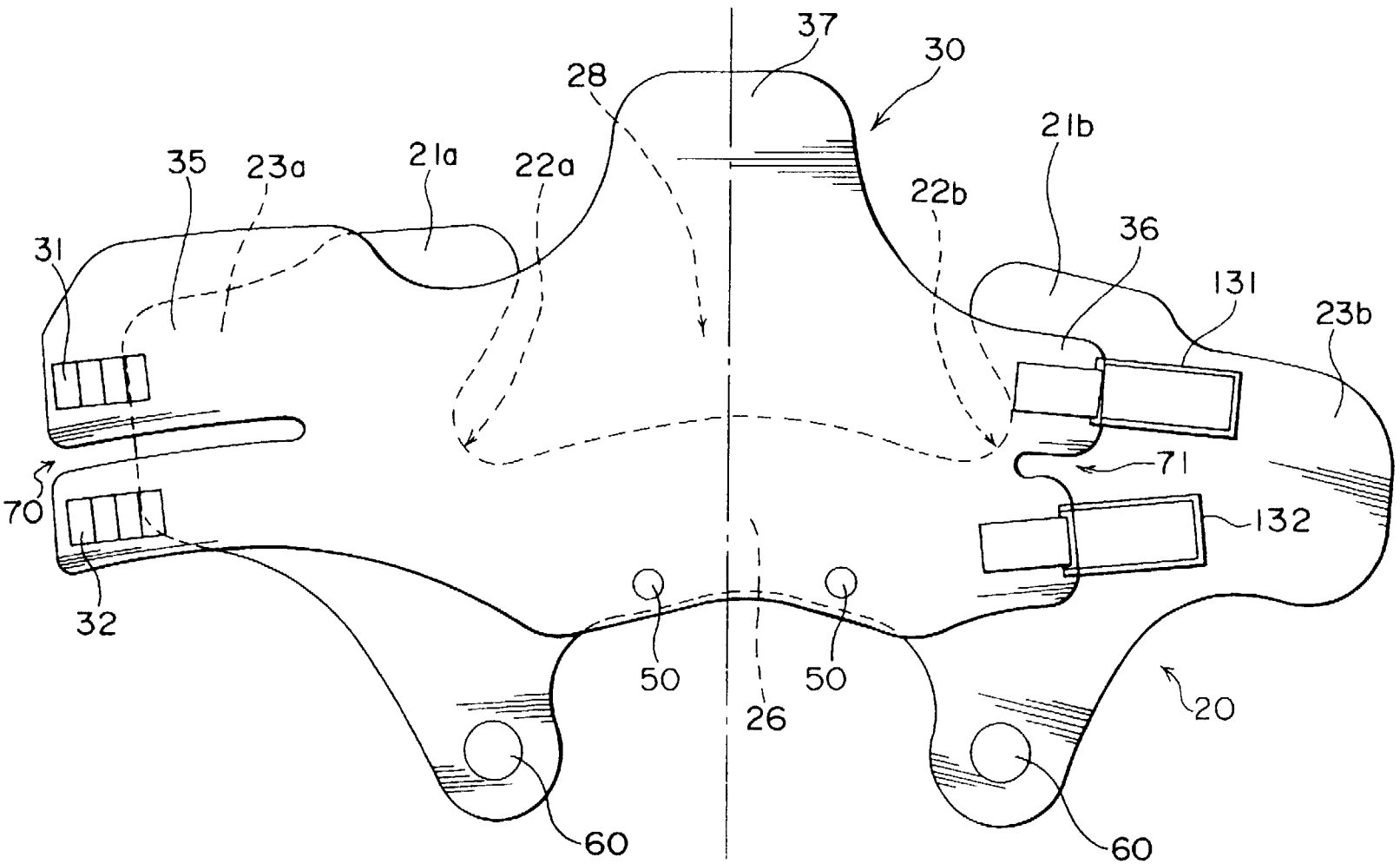
FIG. 6 is a development of a combination of the inner cuff of FIGS. 4 and 5 and the outer cuff of FIG. 5.

The outer cuff 30 is set in a manner to wrap the inner cuff 20 from outside, as indicated in FIG. 5. The outer cuff 30 is fixed to the inner cuff 20 and lower shell 10 by the fixing means 50 such as pins or the like. Two pins 50 are used at the side of the rear face of the ski boot, each of which fixedly secures the three members, i.e., lower shell, inner cuff and outer cuff at one point integrally. The three members constituting the shell of the ski boot are accordingly united in one body. For the sake of easy understanding of the constitution of the ski boot, only the inner cuff 20 is attached to the lower shell 10 in FIG. 4. However, actually, both the inner cuff and the outer cuff are integrally mounted to the lower shell by means of the pins 50, that is, it never happens that the inner cuff alone is fitted to the lower shell.

The outer cuff 30 clamps the inner cuff 20 from outside with the use of two pairs of buckles. As shown in FIG. 6, each buckle consists of a hook 31, 32 and a main body 131, 132. The hook 31, 32 and the main body 131, 132 of each buckle are fixed to a front wall 35 and a side wall 36 of the outer cuff 30, respectively. A notch 70 runs nearly horizontally from a side edge of the front wall 35 between the upper and lower hooks 31 and 32 disposed in the front wall 35. This notch 70 separates the hook 31 related to clamping of the calf portion from the hook 32 related to clamping of the ankle portion, whereby the clamping of the calf and ankle portions is effected highly independently of each other. The ski boot fits flexibly in conformity with the shape of the ankle to the calf of every skier. The outer cuff 30 also has a notch 71 formed between the buckle main bodies 131 and 132 arranged up and down on the side wall 36, from the same reason as above.

The hooks and main bodies may be disposed oppositely, that is, the hooks may be secured to the side wall, with the main bodies secured to the front wall. However, it is more convenient to arrange the main bodies at the side wall in order to manipulate the buckles with ease.

In the example of FIG. 6, the recessed portions 22*a*, 22*b* formed in the side walls 21*a*, 21*b* of the inner cuff 20 are large enough to define a recess 28 at a back wall 26 of the inner cuff. In this case, although the inner cuff 20 is restricted within a slight rise at the back wall 26, a back wall 37 of the outer cuff 30 rises slightly enough to cover the recess 28 of the inner cuff 20, thereby securing sufficient strength to the backward tilting of the leg. The recess 28 formed in the back wall 26 of the inner cuff 20 allows the side walls 21*a*, 21*b* to readily keep up with a shape change from the ankle to the calf of every skier, so that the sense of fitness is improved. Needless to say, the recess 28 in the back wall of the inner cuff may be eliminated and the back wall may be extended sufficiently high, in which case the rigidity and the strength to the backward tilting are both enhanced to favorably meet the need as a racing ski boot.

The inner cuff and the outer cuff of the present ski boot are preferably different in hardness. Since the inner cuff is intended to increase the rigidity at both side portions of the ski boot as discussed earlier, the inner cuff is preferred to be harder than the outer cuff. In contrast, the outer cuff is aimed to realize flexible clamping corresponding to differences in shape of skiers' legs (from the ankle to the calf), and therefore preferred to be more flexible than the inner cuff. Although the ski boot according to the present invention satisfies both the convenience of operation and the sense of fitness, the operability or ease of use is increased more as the inner cuff is made more rigid. Therefore, it is advisable to increase the rigidity of the inner cuff if the ski boot is to be used by skilled people, for example, on the occasion of races, etc.

Even though the inner cuff is made of a highly rigid material, the inner cuff itself is in a free state because the inner cuff is not clamped directly by buckles, unlike the outer cuff. The inner cuff is deformable to a certain extent relatively to the clamping strength at the ankle portion and the calf portion by the outer cuff. That is, inner diameters of the ankle portion and calf portion of the inner cuff are relatively changeable.

Figure 7:
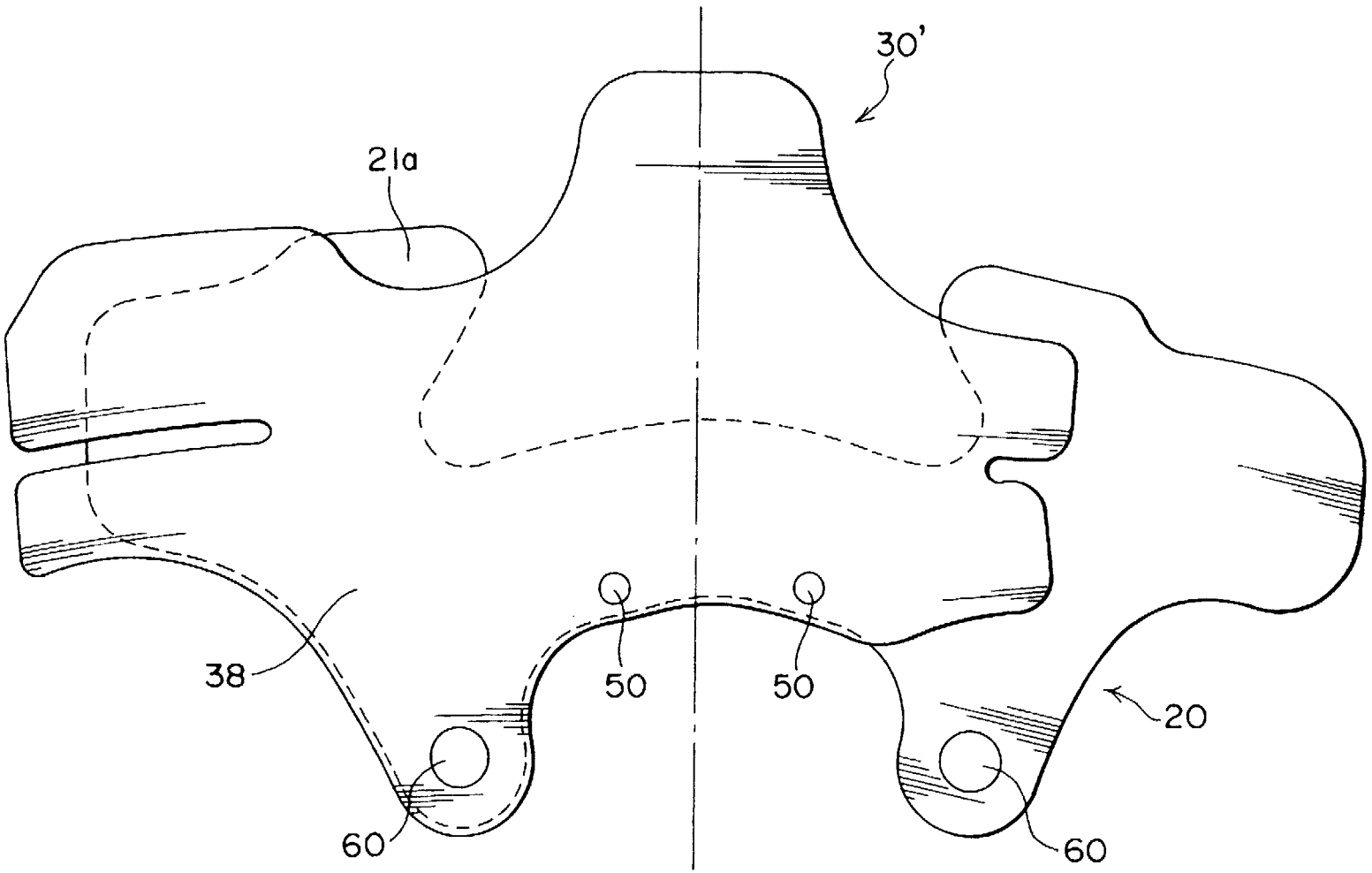
FIG. 7 is a development of the inner cuff and an outer cuff in another form.

A modification of the outer cuff will be depicted with reference to FIG. 7. In the modified example of FIG. 7, the lower shell 10 and the inner cuff 20 are the same as described hereinabove, but the outer cuff is different in shape. Buckles are not shown in FIG. 7.

According to the modification, a side wall 38 of an outer cuff 30' at the inner side of the leg extends down to the side hinge 60 to totally cover the inner side wall 21*a* of the inner cuff. The constitution results from a design attaching more importance to the rigidity of the inner side portion, thus losing some degrees of clamping freedom. The modified ski boot is consequently suitable for use in races. As a further modification from FIG. 7 to make much importance of high rigidity, only a side wall of the outer cuff at the outer side of the leg may be extended down to the side hinge 60, or both side walls of the outer cuff may be extended to the hinges 60.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A ski boot comprising, a lower shell having inner and outer side portions which are restricted to rise approximately to a height of an ankle of a leg to be inserted therein, an inner cuff fixed to the lower shell, said inner cuff having a pair of side walls for covering and supporting an upper part of the leg above the ankle, a pair of front walls for covering and supporting a shin of the leg and a rear wall connecting the pair of the side walls, the pair of front walls having first free ends such that said front walls overlap each other at the front of the shin, and an outer cuff fixed to the lower shell and the inner cuff, the outer cuff having second free ends and being clamped in a manner to wrap the inner cuff from outside, said outer cuff having an upper buckle for clamping a cuff portion of the leg and a lower buckle for clamping an ankle portion of the leg, said rear wall of the inner cuff having a recess at rear and upper part thereof which is covered by a rear part of said outer cuff so that the rear wall of the inner cuff is lower than the side walls thereof.

2. A ski boot according to claim 1, wherein the front wall of the outer cuff terminates in a first of said second free ends, the front wall of the outer cuff covering the front walls of the inner cuff, the outer cuff also including a side wall terminating in a second of said second free ends, the side wall of the outer cuff for covering the side wall of the inner cuff.

3. A ski boot according to claim 2, wherein the first of said second free ends has a first notch extending between the upper and lower buckles and the second of said second free ends has a second notch extending therefrom between the upper and lower buckles.

4. A ski boot according to claim 1, wherein said inner cuff is relatively more rigid than said outer cuff.

* * * * *